United States Patent [19]

Carlsson

[11] 4,442,956

[45] Apr. 17, 1984

[54] APPARATUS FOR EMPTYING SINGLE OR MULTI-WALLED PACKAGES

[76] Inventor: Sune J. R. Carlsson, Tallåsvägen 8, Falkenberg, Sweden

[21] Appl. No.: 285,188

[22] PCT Filed: Nov. 5, 1980

[86] PCT No.: PCT/SE80/00275

§ 371 Date: Jul. 6, 1981

§ 102(e) Date: Jul. 6, 1981

[87] PCT Pub. No.: WO81/01278

PCT Pub. Date: May 14, 1981

[30] Foreign Application Priority Data

Nov. 5, 1979 [SE] Sweden ..... 7909146

[51] Int. Cl.[3] ..... B65D 33/36; B65B 69/00

[52] U.S. Cl. ..... 222/185; 222/529

[58] Field of Search ..... 222/105, 181, 185, 529; 150/8, 9

[56] References Cited

U.S. PATENT DOCUMENTS

| | | | |
|---|---|---|---|
| 553,752 | 1/1896 | Goff | 222/181 X |
| 3,464,594 | 9/1969 | Forman | 222/185 |
| 3,777,938 | 12/1973 | Nikowitz et al. | 222/105 X |
| 4,167,235 | 9/1979 | Green | 222/181 X |

*Primary Examiner*—F. J. Bartuska

*Attorney, Agent, or Firm*—Beveridge, DeGrandi and Kline

[57] ABSTRACT

A package emptying device has a support for the package, and a ring which is engaged with the outlet portion of the package. The ring is downwardly movable to stretch the package and avoid folds which impede the emptying of the package.

5 Claims, 2 Drawing Figures

APPARATUS FOR EMPTYING SINGLE OR MULTI-WALLED PACKAGES

TECHNICAL FIELD

The present invention relates to an apparatus for emptying single or multi-walled packages, for example sacks (large sacks), bags etc., which have a discharge mouth which is formed by a part of the package wall or a specially provided socket.

THE STATE OF THE ART/TECHNICAL PROBLEM

In the handling of certain bulk materials, it is, int. al. for reasons of hygiene, desirable to provide for as good as completely enclosed filling and emptying of the utilized package, in particular in the handling of foodstuffs and starting materials for the manufacture of foodstuffs, medicines etc. In such cases, the package normally consists of single or multi-walled sacks (large sacks), bags or the like. In order to facilitate enclosed emptying of such a package, it is normally provided with an under socket.

Emptying via this under socket has, however, proved to entail such problems as the formation of folds which render the emptying operation more difficult.

The object of the present invention is to realise an apparatus which allows for emptying of single or multi-walled packages with an under socket or the like, without incurring any problems in fold formation, in which case it should also be possible to effect emptying in an enclosed manner.

SOLUTION

The present invention satisfies the above-disclosed object in that the apparatus described by way of introduction is provided with a support for carrying the package which is to be emptied with the discharge mouth downwardly directed and extending through an opening in the package support in order to surround a ring in an outlet member, which ring is shiftable for stretching the package wall or the socket. Advantageously, the ring is located about a frame for supporting the package wall or socket, primarily when the ring is located in its shifted, lower position. It is suitable that the outlet member be fixedly disposed beneath the opening in the support, that the frame be upwardly directed, and that the ring be mounted by means of a bellows device which extends about the frame. Preferably, the frame has at least one shoulder on which the ring rests in its upper position in which the package wall or socket is applied thereon. For controlled emptying of the package, it is appropriate that the outlet member be provided with an outlet portion which in its turn is provided with a throttle.

ADVANTAGES

In an apparatus according to the present invention, stretching of the socket takes place during emptying of the package, whereby making for enclosed emptying and preventing the formation of folds which would render the emptying procedure more difficult.

DESCRIPTION OF THE ACCOMPANYING DRAWINGS

Figure 1:
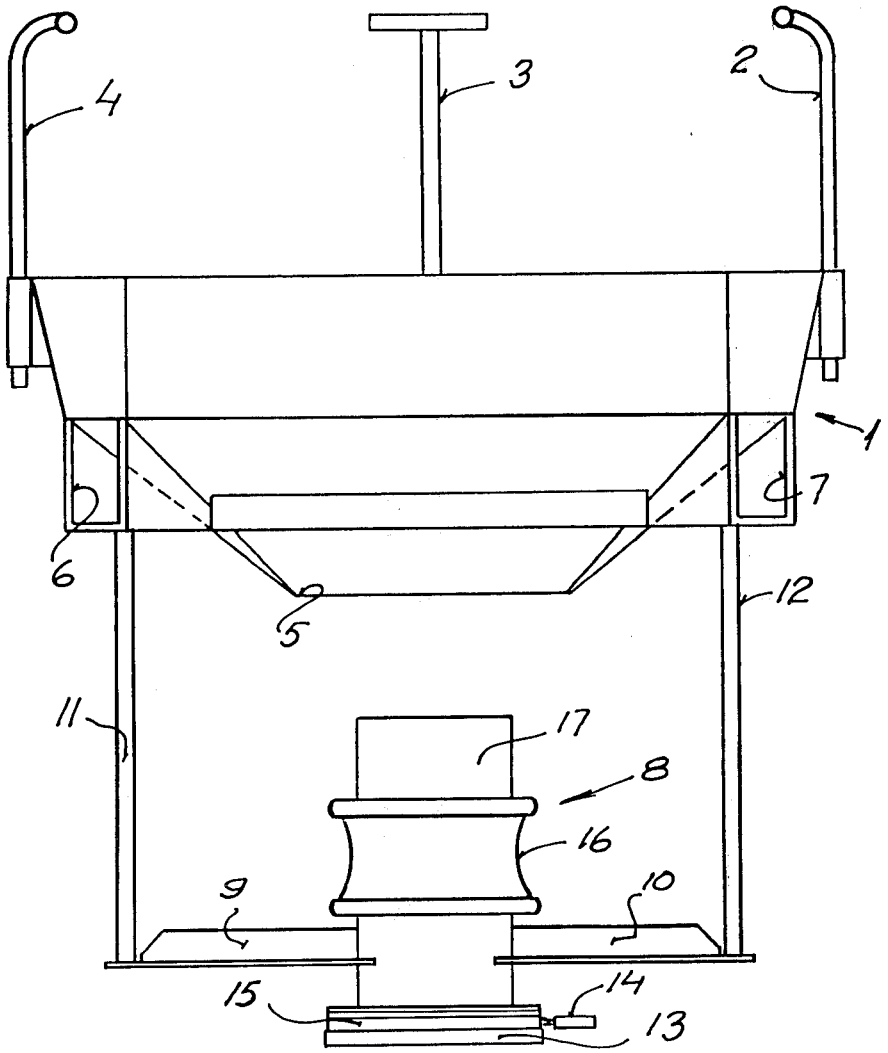
Figure 2:
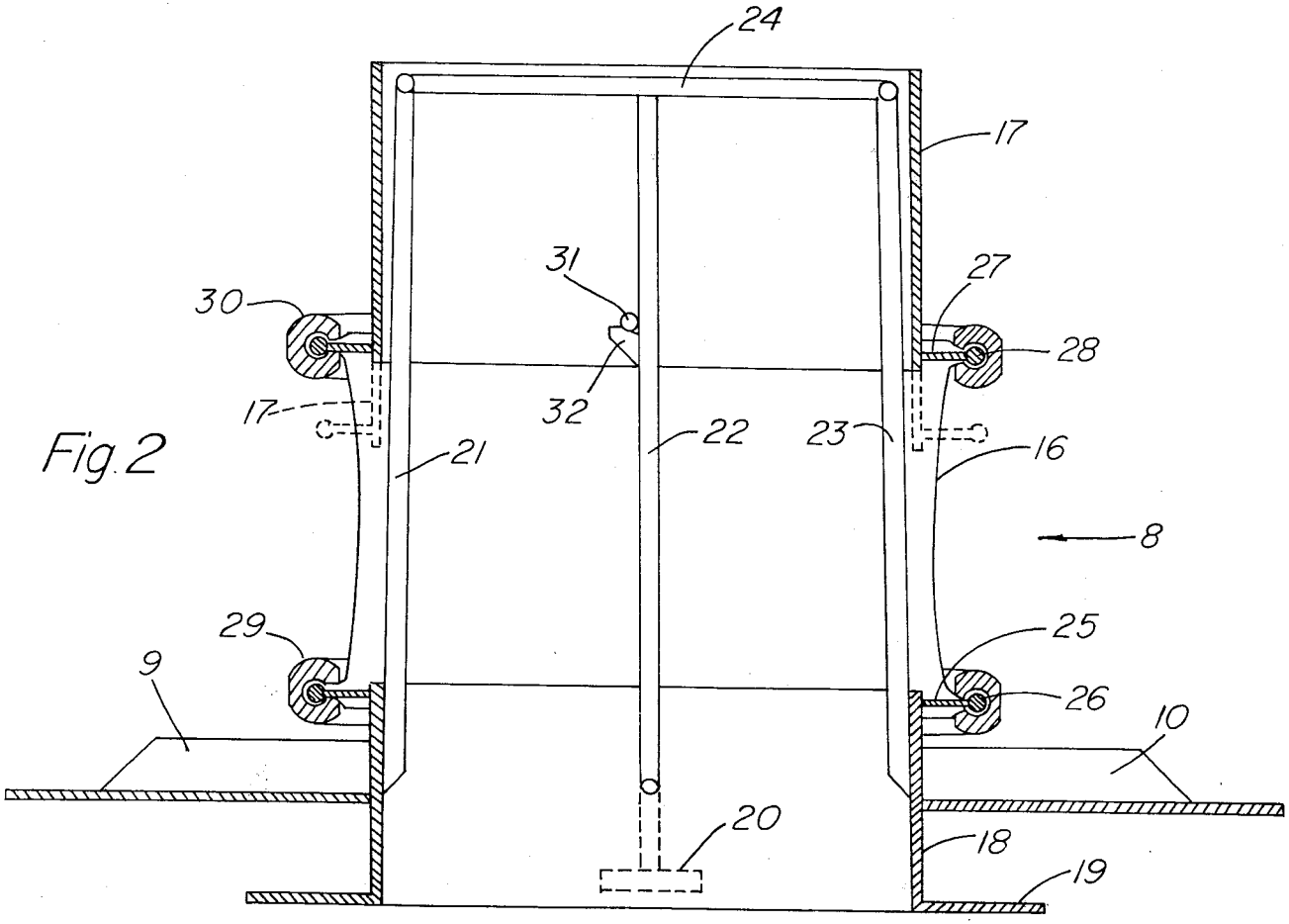

The invention will be described in greater detail below with reference to the accompanying drawings, in which, FIG. 1 is a schematic side elevation of one embodiment of an apparatus according to the present invention; and FIG. 2 shows, on a larger scale, a section through a part of the apparatus of FIG. 1.

The embodiment of an apparatus according to the present invention shown on the drawings is provided with a package support 1 with stays 2, 3 and 4. The stays 2–4 prevent a large sack which is placed in the support 1 from falling over. The support 1 is substantially bowl-shaped and has a centrally located bottom opening 5. Through this opening, the lower socket of a package or large sack which is to be emptied may extend. Furthermore, the support 1 is provided with suspension members 6 and 7 for cooperation with, for example, the forks of a fork-lift truck.

Beneath the opening 5, there is disposed an outlet member 8 which is suspended from the support 1 by means of cross stays 9 and 10 and vertical stays 11 and 12. Although but two cross stays and two vertical stays are shown, the apparatus my be provided with two further cross stays and two further vertical stays, if desired. Furthermore, the outlet member 8 is provided with a throttle portion 13 which includes a throttle 15 operable by means of a handle 14 for controllable emptying of a package connected to the outlet member 8. The outlet member is further provided with a bellows 16 and a connection ring 17. The outlet member will be described in greater detail below with reference to FIG. 2.

As is more clearly apparent from FIG. 2, the outlet member 8 consists of a lower ring 18 on which the throttle portion 13 is mounted by the intermediary of a mounting flange 19. Furthermore, on the ring 18 there are fixedly disposed the cross stays 9 and 10, as well as two further cross stays 20. From the upper inner side of the ring 18 extend a number of frame rods 21, 22 and 23 which extend up to a frame ring 24. Moreover, a flange 25 is disposed about the upper end of the ring 18, the edge of the flange presenting a ring 26. The connection ring 17 has an almost identical flange 27 with a ring 28. The bellows 16 is disposed between the rings 17 and 18 and may consist of some suitable fabric-reinforced plastic sheeting or the like which is fixedly clamped on the rings 26 and 28 by means of clamping rings 29 and 30. Thus, the connection ring 17 will be shiftable along the frame consisting of the rods 21-23, and may be secured in the upper, illustrated position in that an anchorage pin 31 disposed on its inside is turned in over a stop abutment 32 on the frame rod 22. Turning of the connection ring 17 and shifting thereof are made possible thanks to the bellows 16. The connection ring 17 in FIG. 1 is shown in the same position as the connection ring 17 in FIG. 2.

When it is desirable to empty a sack provided with a lower socket, the sack is placed in the support 1 and the lower socket is moved through the opening 5. Thereafter, the free portion of the socket is passed over the connection ring 17 and secured thereon by means of some tightenable strap or the like so that the connection between the socket and the connection ring 17 will be as tight as is desirable. It should, on this point, be noted that the ring 17 is in the position shown on the drawing. After connection of the socket to the ring 17, the ring 17 is lifted and turned so that the members 31 and 32 are separated from each other and the ring 17 may be shifted in a direction towards the ring 18. The package is normally sealed in that the socket is puckered together and strung in the vicinity of the sack itself. After the above-disclosed phases, the closure of the socket is removed, whereby the socket is stretched out in that the ring 17 moves in a direction towards the ring 18. The contents of the package will then run down to the throttle portion 13 which may be sealingly connected to some type of container or the like.

Thus, the ring 17 stretches the socket, and the frame formed by the frame rods 21, 22 and 23, as well as the ring 24, prevent, on the one hand, the bellows sheet 16 from folding in to the outlet member 8 and hindering emptying of the package, and, on the other hand, prevent folding of the scoket into the outlet member 8 in the event that shifting of the ring 17 towards the ring 18 is not sufficient to completely stretch out the socket.

The apparatus described above is, naturally, not restricted to the emptying of packages provided with a lower socket, but can, of course, be used also in conjunction with other types of packages where the socket is replaced by the package wall itself.

I claim:

1. An apparatus for emptying packages which have discharge mouth portions, comprising support means for supporting the package which is to be emptied, said support means having an opening which permits the discharge mouth portion of the package to extend downwardly below the support means, an outlet member located below the support means and having a ring for engaging the discharge mouth portion of the package, said ring being shiftable from an upper position to a lower position, said ring when in its upper position being engageable with the discharge mouth position of a package which is supported on the support means, said ring being shiftable downwardly from its upper position to a lower position to stretch the package and avoid the formation of folds which render the emptying operation more difficult, and a frame means located in said ring for entering the discharge mouth portion to prevent the discharge mouth portion from folding inwardly.

2. Apparatus according to claim 1 wherein the outlet member has a throttle portion for regulating the emptying of a package.

3. Apparatus according to claim 1 wherein the frame means is stationary relative to the support means, and a bellows device which extends around the frame, said ring being connected to the upper end of the bellows device.

4. Apparatus according to claim 3 wherein the frame means has a shoulder means for supporting the ring in its upper position.

5. Apparatus according to claim 1 wherein the frame means has a shoulder means for supporting the ring in its upper position.

* * * * *